US009226059B1

(12) United States Patent
Knight

(10) Patent No.: US 9,226,059 B1
(45) Date of Patent: Dec. 29, 2015

(54) YOUR MUSIC FOR ETERNITY SYSTEMS

(71) Applicant: John Knight, Rancho Cucamonga, CA (US)

(72) Inventor: John Knight, Rancho Cucamonga, CA (US)

( * ) Notice: Subject to any disclaimer, the term of this patent is extended or adjusted under 35 U.S.C. 154(b) by 144 days.

(21) Appl. No.: 14/242,743

(22) Filed: Apr. 1, 2014

Related U.S. Application Data

(60) Provisional application No. 61/827,139, filed on May 24, 2013.

(51) Int. Cl.
*H04R 1/02* (2006.01)
*A61G 17/04* (2006.01)
*E04H 13/00* (2006.01)

(52) U.S. Cl.
CPC ..... *H04R 1/028* (2013.01); *A61G 17/04* (2013.01); *E04H 13/003* (2013.01)

(58) Field of Classification Search
None
See application file for complete search history.

(56) References Cited

U.S. PATENT DOCUMENTS 5,404,343 A * 4/1995 Boggio ..... E04H 13/003 360/12
6,324,736 B1 * 12/2001 Atrio ..... A61G 17/04 27/14
6,340,978 B1 * 1/2002 Mindrum ..... G06Q 10/10 715/733
7,765,655 B2 8/2010 Dannenberg
8,068,035 B1 * 11/2011 Salcedo et al. ..... E04H 13/003 320/101
2001/0036354 A1 11/2001 Majors
2003/0208890 A1 11/2003 Kim
2006/0236326 A1 * 10/2006 Aguirre ..... G06F 1/1626 719/322
2010/0146752 A1 * 6/2010 Dannenberg ..... A61G 17/04 27/2
2011/0047893 A1 * 3/2011 Iezza ..... E04H 13/003 52/103

FOREIGN PATENT DOCUMENTS

BE 1012682 A6 * 2/2001 ..... E04H 13/003
DE 1501266 A2 * 1/2005 ..... H04M 1/6033
JP 2002121931 A * 4/2002
KR 100543097 B1 * 1/2006

OTHER PUBLICATIONS

Pause, The Catacombo Sound System, published Dec. 2012, https://web.archive.org/web/20121214073350/http://catacombosoundsystem.com/.*
English machine translation of KR 10-0543097 B1 (Park, Young Hun; Virtual Death Experience (Coffin for having imaginary death experience); published Jan. 2006).*

* cited by examiner

*Primary Examiner* — Wayne Young
*Assistant Examiner* — Mark Fischer
(74) *Attorney, Agent, or Firm* — RG Patent Consulting, LLC; Rachel Gilboy

(57) ABSTRACT

A solar powered digital music player for a grave system is a digital music player assembly that is adapted for use with a grave marker and a corresponding casket. The casket may have at least one interior speaker. An electronic digital music player is located in a secure box near the bottom of the grave marker. An external jack on the grave marker accesses the electronic digital music player in the grave marker. Internally, the grave marker is molded with the first conductive wires which are the solar panel power cord and the headphone jack wire harness internally cast and extending to the digital music player in the secure box within the grave marker, and through the bottom of the grave marker to a coupler. The plurality of second conductive wires, bound in a harness, connect the casket to the electronic digital music player located in the grave marker.

18 Claims, 5 Drawing Sheets

YOUR MUSIC FOR ETERNITY SYSTEMS

CROSS-REFERENCE TO RELATED APPLICATION

The present application is related to and claims priority from prior provisional application Ser. No. 61/827,139, filed May 24, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of burial accessories and more specifically relates to a solar powered digital music player for a grave system.

2. Description of the Related Art

There is one thing that is certain for every human on earth and something all living beings hold in common and that is the guarantee of death. Whether a sudden and unexpected passing, or a result of a long-term illness, death eventually will find us all. The most typical reaction to the death of a loved one is to celebrate and honor the life of the departed, via a wake or a funeral. Allowing family members to gather, friends to reminisce and providing an outlet for people to express their love and fond memories of the departed, funerals and memorial services offer a sense of closure for those loved ones who are left behind.

Most often, the remains of the departed are dealt with according to individual or familial preference and are either buried or cremated. As a means of enhancing services offered to those who have suffered the loss a loved one, funeral providers are increasingly looking towards modern technology in order to provide better service and a more personalized experience during a difficult time. From online guest books that enable out-of-towners to send personalized messages to the family of the deceased, to interactive video presentations played at funerals and cemeteries that celebrate the life of the departed, funeral directors are constantly in search of the newest products that will result in a more positive and comforting experience for those grieving a painful loss.

Various attempts have been made to solve the above-mentioned problems such as those found in U.S. Pat. No. 7,765,655 to Jeff Dannenberg, U.S. Pub No. 2001/0036354 to Lisa M. Majors, and U.S. Pub. No. 2003/0208890 to Stanley D. C. Kim. This art is representative of burial accessories. None of the above inventions and patents, taken either singly or in combination, is seen to describe the invention as claimed.

Ideally, a burial accessory should provide comfort for the living friends and relatives of a deceased, and yet, would operate reliably and be manufactured at a modest expense.

Thus, a need exists for a reliable solar powered digital music player for a grave system to avoid the above-mentioned problems.

BRIEF SUMMARY OF THE INVENTION

In view of the foregoing disadvantages inherent in the known burial accessory art, the present invention provides a novel solar powered digital music player for a grave system. The general purpose of the present invention, which will be described subsequently in greater detail, is to provide permanently recorded music for listening to at any time by friends and relatives of a deceased.

The present invention, solar powered digital music player for a grave system as disclosed herein, preferably comprises a grave digital music player assembly having a grave marker with a top, at least one vertical side, an interior portion, at least one solar panel, at least one first speaker jack, and a plurality of first conductive wires, an electronic digital music player having at least one speaker, a signal splitter, at least one second speaker jack, a plurality of second conductive wires, and at least one rechargeable battery.

The grave digital music player assembly may be able to play at least one musical sound for listener-users visiting a grave site. The grave digital music player assembly is able to output a plurality of stored digitally recorded songs to one first speaker jack and one second speaker jack. At least one solar panel is arranged along the top side of the grave marker such that it is able to collect available sunlight and convert the available sunlight into a stored electrical power within the rechargeable battery. The rechargeable battery is a long-life battery preferably of the Lithium Ion type or better.

At least one first speaker jack is located on a vertical side of the grave marker. In a preferred embodiment, the grave digital music player assembly is a play-only system having only one headphone jack located on the grave marker. The first speaker jack and the plurality of first conductive wires are cast within the grave marker during a manufacturing process such that a coupling end of the at least one first speaker jack is exposed to an exterior of the grave marker. The grave marker also may have a secure, water-tight compartment for housing the electronic digital music player. The electronic digital music player may have an internal signal splitter and have more than one jack plug or may have an external signal splitter located with the electronic digital music player in the secure box. The first speaker jack and the second speaker jack comprise water-tight connections. The plurality of first conductive wires and the plurality of second conductive wires also comprise water tight terminal endings.

The plurality of first conductive wires are located within the interior portion of the grave marker and are in conductive communication with the solar panel(s), the first speaker jack(s), the electronic digital music player, and the rechargeable battery(s). The plurality of first conductive wires further may comprise at least one input conductor to the electronic digital music player. The plurality of first conductive wires comprises a power conductor wire from the solar panel(s) to the rechargeable battery and at least one conductor from the first speaker jack to the electronic digital music player. The grave digital music player assembly may further comprise a removable data storage device for high volume data storage.

The electronic digital music player is located in a sealed box near the bottom side of the grave marker so that it is accessible for repairs or maintenance. The speaker is removably attached within the inner volume of the casket for playing a recorded sound continuously when a battery voltage charge meets at least a minimum required charge level for the grave digital music player assembly. At least one second speaker jack is located within the sidewall of the casket such that a male speaker jack is able to couple thereto from an exterior of the casket. The plurality of second conductive wires are in communication with the electronic digital music player via a recorder-player jack, the second speaker jack, the speaker, the casket speaker jack and the rechargeable battery.

The grave digital music player assembly may further comprise a casket speaker jack on the exterior of the casket for conductively coupling the casket speaker to the electronic digital music player. The conductive coupling means for coupling the casket speaker jack to the electronic digital music player further comprises water tight connections. The rechargeable battery is in communication with the plurality of first conductive wires, the solar panel(s), the first speaker jack(s), the electronic digital music player, the second speaker jack(s), and the speaker(s). The grave digital music player assembly is useful for recording at least one musical sound for playback at a later time to a user-listener via the speaker and the first speaker jack to provide a memory and comfort to the user-listener.

A kit is embodied herein for the solar powered digital music player for a grave system preferably comprising: a grave marker having at least one solar panel and at least one first speaker jack in communication with the plurality of first conductive wires; an electronic digital music player; at least one speaker; at least one second speaker jack; at least one rechargeable battery; a plurality of second conductive wires able to be in communication with a grave marker, an electronic digital music player, at least one speaker; at least one second speaker jack, at least one rechargeable battery; and at least one set of user installation instructions.

In accordance with the embodiments of the present invention a preferred method of use is disclosed herein preferably comprising the steps of: setting a grave marker; connecting plurality of second conductive wires to plurality of first conductive wires; connecting a plurality of second conductive wires to a casket and to a plurality of first conductive wires of a grave marker; lowering the casket into an excavated hole beneath the ground surface; burying the casket; plugging at least one headphone set into at least one first speaker jack to listen to a pre-recorded song; and unplugging the digital music player from the first speaker jack.

The present invention holds significant improvements and serves as a solar powered digital music player for a grave system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, solar powered digital music player for a grave system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a burial accessory and more particularly to a solar powered digital music player for a grave system as used to provide music for the friends and relatives of a deceased.

Generally speaking, a solar powered digital music player for a grave system is a digital music assembly that is adapted for use with a grave marker and a corresponding casket. The casket may have at least one interior speaker. An electronic digital music player is located in a secure box within and near the bottom of the grave marker. External jacks on the casket connect the casket speaker to the digital music player in the grave marker. Internally, the grave marker is molded with the first conductive wires which are the solar panel power cord and the headphone jack wire harness internally cast and extending to the secure box near the bottom and then through the bottom of the grave marker to a coupler. A plurality of second conductive wires, bound in a harness, connect the casket to the electronic digital music player. The assembly is able to convey songs to future visitor-listeners.

Figure 1:
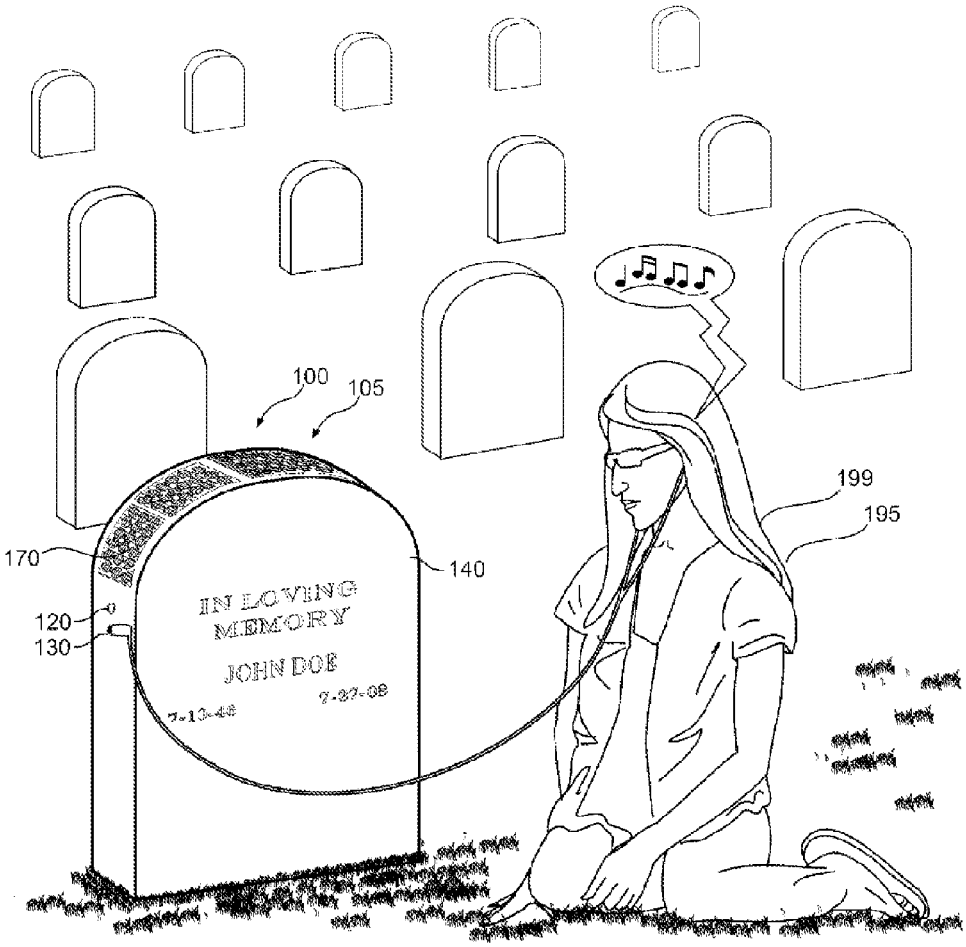
FIG. 1 shows a perspective view illustrating an in-use condition of a solar powered digital music player for a grave system according to an embodiment of the present invention.

Referring to the drawings by numerals of reference there is shown in FIG. 1, a perspective view illustrating an in-use condition of solar powered digital music player for a grave system 100 according to an embodiment of the present invention.

Grave digital music player assembly 105 is useful for recording at least one song for playback at a later time to user-listener 199 via speaker 110 and first speaker jack 120 to provide memories and comfort to user-listener 199. Grave digital music player assembly 105 is able to output a plurality of stored digitally recorded songs to at least one first speaker jack 120 and to second speaker jack 160.

Solar powered digital music player for a grave system 100 preferably comprises grave digital music player assembly 105 having grave marker 140 with top 142, at least one vertical side 144, an interior portion 146, at least one solar panel 170, at least one first speaker jack 120, and a plurality of first conductive wires 180, electronic digital music player 150 having at least one speaker 110, at least one second speaker jack 160, a plurality of second conductive wires 190, and at least one rechargeable battery 200.

Figure 2:
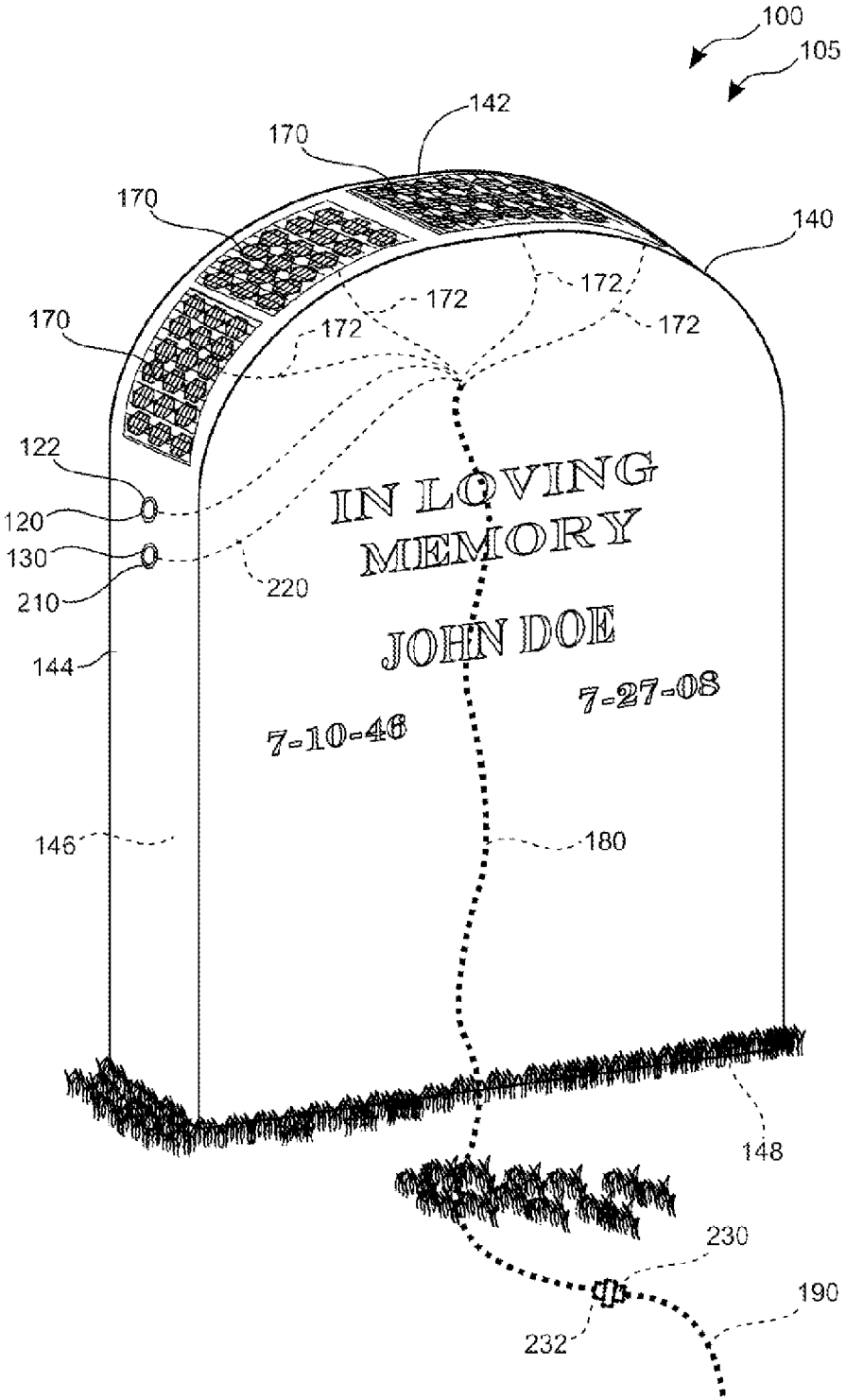
FIG. 2 is a perspective view illustrating a vertical grave marker of the solar powered digital music player for a grave system according to an embodiment of the present invention of FIG. 1.

Referring now to FIG. 2, a perspective view illustrating vertical grave marker 140 of solar powered digital music player for a grave system 100 according to an embodiment of the present invention of FIG. 1.

At least one solar panel 170 is arranged along top 142 of grave marker 140 such that it is able to collect available sunlight and convert the available sunlight into a stored electrical power within rechargeable battery 200. Those with skill in the art will realize the application and means whereby collection of sun rays from sunlight may be used to power devices. Rechargeable battery 200 is in communication with the plurality of first conductive wires 180, solar panel(s) 170, first speaker jack(s) 120, electronic digital music player 150, second speaker jack(s) 160, and speaker(s) 110. At least one first speaker jack(s) 120 is located on vertical side 144 of grave marker 140. Grave marker 140 further may comprise digital output jack 210 such that user-listener 199 is able to listen to a pre-recorded song at any time. First speaker jack(s) 120 and the plurality of first conductive wires 180 are cast within grave marker 140 during a manufacturing process such that coupling end 122 of first speaker jack(s) 120 are exposed to an exterior of grave marker 140. The plurality of first conductive wires 180 comprises a power conductor wire 172 from solar panel(s) 170 to rechargeable battery 200 and at least one conductor from first speaker jack(s) 120 to electronic digital music player 150.

Figure 3:
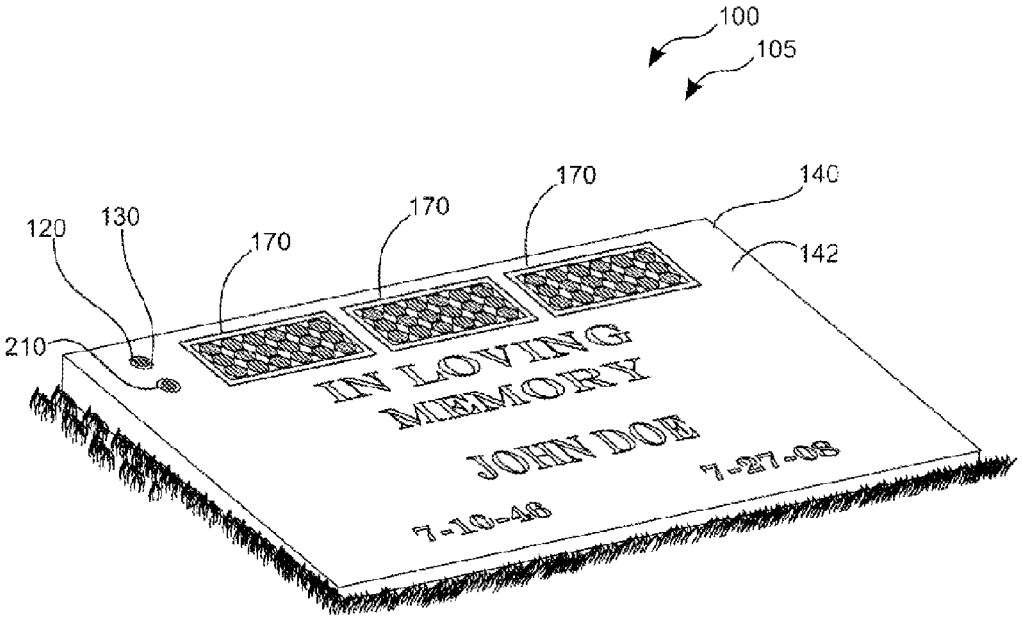
FIG. 3 is a perspective view illustrating a flat grave marker of the solar powered digital music player for a grave system according to an embodiment of the present invention of FIG. 1.

Referring now to FIG. 3, a perspective view illustrating flat grave marker 140 of solar powered digital music player for a grave system 100 according to an embodiment of the present invention of FIG. 1.

First speaker jack(s) 120 and second speaker jack(s) 160 comprise water-tight connections to provide long life span for the connections. A plurality of first conductive wires 180 and a plurality of second conductive wires 190 also comprise water tight terminal endings which are preferably corrosion resistant. First conductive wires 180 are located within interior portion 146 of grave marker 140 and are in conductive communication with solar panel(s) 170, first speaker jack(s) 120, electronic digital music player 150, and rechargeable battery(s) 200. First conductive wires 180 are preferably enclosed into a water-tight harness and has a water-tight coupler 230 for attachment to second conductive wires 190. Water-tight coupler 230 may be a twist-lock type connection with permanent seals having no metal parts exposed when coupled. Attachment end 232 of water-tight coupler 230 may extend exteriorly of bottom end 148 of grave marker 140.

Figure 4:
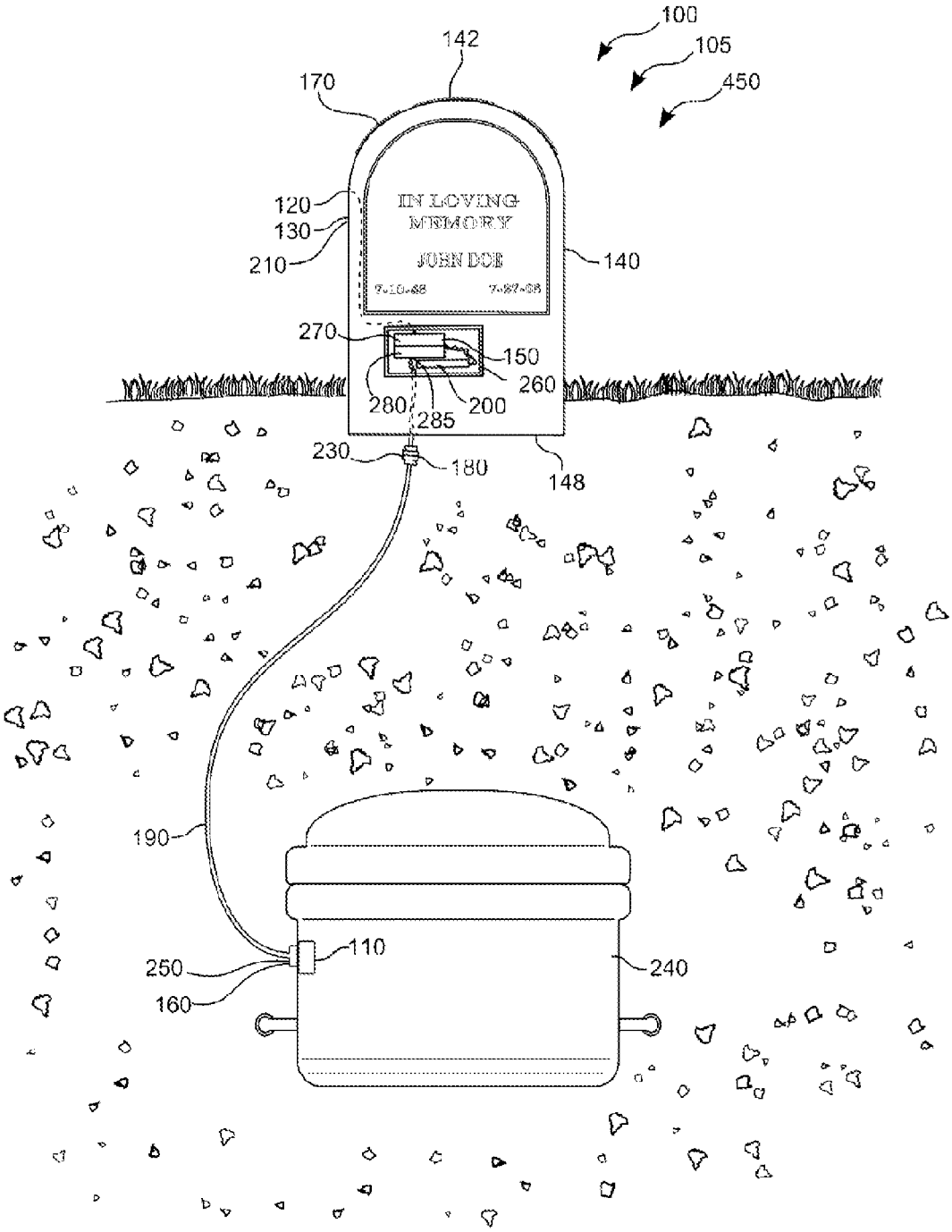
FIG. 4 is a perspective view illustrating profile view of the solar powered digital music player for a grave system according to an embodiment of the present invention of FIG. 1.

Referring now to FIG. 4, showing a perspective view illustrating a profile view of solar powered digital music player for a grave system 100 according to an embodiment of the present invention of FIG. 1.

Rechargeable battery(s) 200 is a long-life battery preferably of Lithium Ion type but may be of other extended life types. Voltage output of solar panel(s) 170 may also power grave digital music player assembly 105 directly from sunlight (incoming rays) absorbed (collected) from solar panel(s) 170 without rechargeable battery(s) 200. Speaker(s) 110 is removably attached within the inner volume of casket 240 for playing a recorded sound continuously when a battery voltage charge meets at least a minimum required charge level for grave digital music player assembly 105. Grave marker 140 may have a secure, water-tight secure box 260 for housing electronic digital music player 150. First conductive wires 180 and second conductive wires 190 also comprise insulated conductors. Electronic digital music player 150 may have an internal signal splitter 285 and have more than one jack plug or may have an external signal splitter 285 located with electronic digital music player 150.

Grave digital music player assembly 105 may further comprise a removable data storage device for high volume data storage in a second embodiment. Electronic digital music player 150 are located in secure box 260 in grave marker 140, and speaker(s) 110 is located within the inner volume of casket 240. At least one second speaker jack(s) 160 is located within the sidewall of casket 240 such that a male speaker jack is able to couple thereto from the exterior of casket 240. Second conductive wires 190 are in communication with electronic digital music player 150 via a digital input/output jack 210, second speaker jack(s) 160, speaker(s) 110, casket speaker jack 250 and rechargeable battery(s) 200. The conductive coupling means for coupling casket speaker jack 250 to electronic digital music player 150 further comprises water tight and corrosion resistant connections. Grave digital music player assembly 105 may further comprise casket speaker jack 250 on the exterior of casket 240 for conductively coupling casket 240 speaker(s) 110 to electronic digital music player 150.

Solar powered digital music player for a grave system 100 may be sold as kit 450 comprising the following parts: at least one grave marker 140 having at least one solar panel(s) 170 and at least one first speaker jack(s) 120 in communication with the plurality of first conductive wires 180; at least one electronic digital music player 150; at least one speaker(s) 110; at least one second speaker jack(s) 160; at least one rechargeable battery(s) 200; a plurality of second conductive wires 190 able to be in communication with grave marker 140, electronic digital music player 150, at least one speaker(s) 110; at least one second speaker jack(s) 160, and at least one rechargeable battery(s) 200; and at least one set of user installation and use instructions. The kit has instructions such that functional relationships are detailed in relation to the structure of the invention (such that the invention can be used, maintained, or the like in a preferred manner). Solar powered digital music player for a grave system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different powering combinations, parts may be sold separately, etc., may be sufficient.

Figure 5:
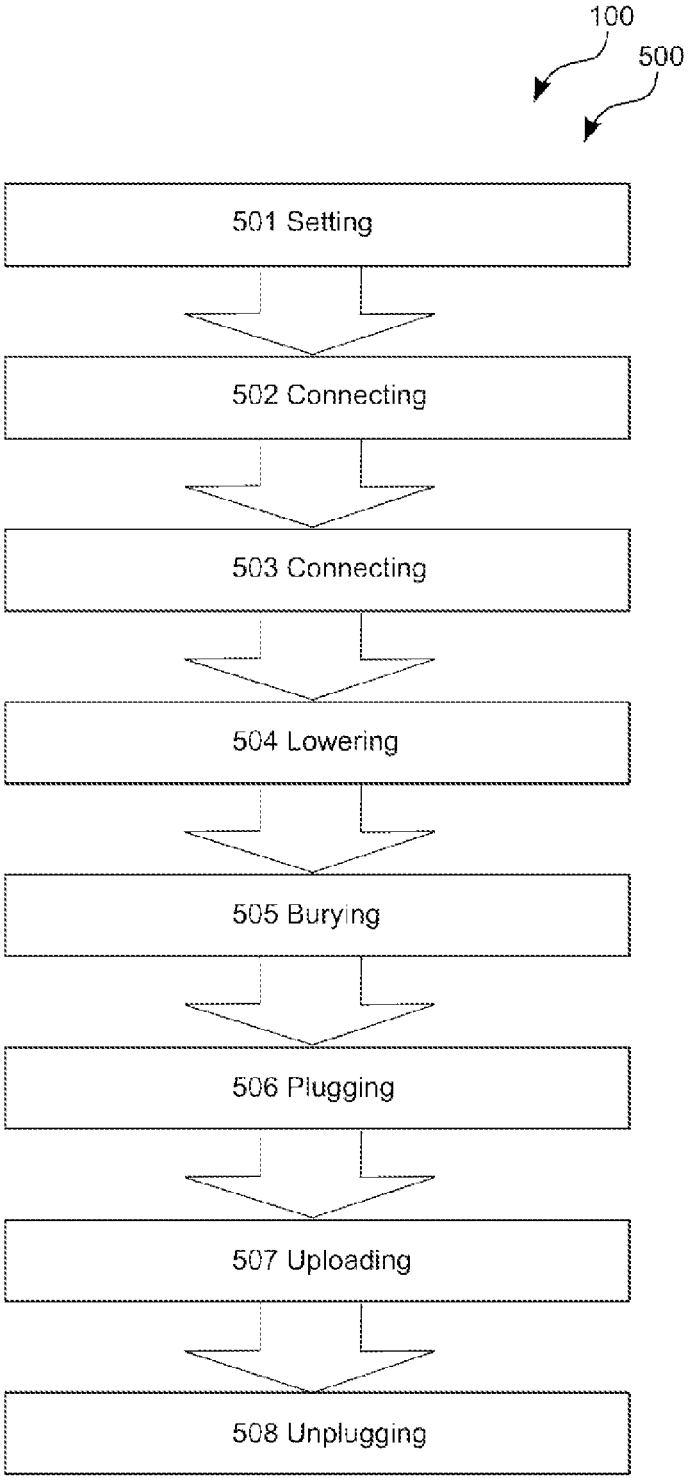
FIG. 5 is a flowchart illustrating a method of use for the solar powered digital music player for a grave system according to an embodiment of the present invention of FIGS. 1-4.

Referring now to FIG. 5, showing method of use 500 for solar powered digital music player for a grave system 100.

A method of using (method of use 500) solar powered digital music player for a grave system 100 may comprise the steps of: step one 501 setting grave marker 140; step two 502 connecting plurality of second conductive wires 190 to plurality of first conductive wires 180; step three 503 connecting a plurality of second conductive wires 190 to casket 240 and to a plurality of first conductive wires 180 of grave marker 140; step four 504 lowering casket 240 into an excavated hole beneath the ground surface; step five 505 burying casket 240; step six 506 plugging at least one headphone set into at least one first speaker jack(s) 120 to listen to a pre-recorded song; and step seven 507 unplugging the listening device from first speaker jack(s) 120.

It should be noted that steps 506 and 507 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A solar powered digital music player for a grave system comprising:

a grave digital music player assembly comprising:

a grave marker having:

a top;

at least one vertical side;

an interior portion;

at least one solar panel;

at least one first speaker jack;

a plurality of first conductive wires;

an electronic digital music player;

at least one speaker;

at least one second speaker jack;

a plurality of second conductive wires; and at least one rechargeable battery;

wherein said grave digital music player assembly is able to play at least one musical sound for a user-listener visiting a grave site;

wherein said at least one solar panel is arranged along said top side of said grave marker such that said at least one solar panel is able to collect available sunlight and convert said available sunlight into a stored electrical power within said at least one rechargeable battery;

wherein said at least one first speaker jack is located on said at least one vertical side of said grave marker;

wherein said plurality of first conductive wires are located within said interior portion of said grave marker and are in conductive communication with said at least one solar panel, said at least one first speaker jack, said electronic digital music player, and said at least one rechargeable battery;

wherein said electronic digital music player is located within a sealed box near a bottom end of said grave marker;

wherein said at least one speaker is located within an inner volume of a casket;

wherein said at least one second speaker jack is located within a sidewall of said casket and on an exterior of said casket such that a male speaker jack is able to couple thereto from an exterior of said casket;

wherein said plurality of second conductive wires are in communication with said electronic digital music player via a recorder-player jack, said at least one second speaker jack, said at least one speaker, and said at least one rechargeable battery;

wherein said at least one rechargeable battery is in communication with said plurality of first conductive wires, said at least one solar panel, said at least one first speaker jack, said electronic digital music player, said at least one second speaker jack, and said at least one speaker; and wherein said grave digital music player assembly is useful for recording said at least one musical sound for playback at a later time to said user-listener via said at least one speaker and said at least one first speaker jack to provide at least one memory and a comfort to said user-listener.

2. The solar powered digital music player for a grave system of claim 1 wherein said at least one first speaker jack and said plurality of first conductive wires are cast within said grave marker during a manufacturing process such that a coupling end of said at least one first speaker jack is exposed to an exterior of said grave marker.

3. The solar powered digital music player for a grave system of claim 1 wherein said at least one first speaker jack and said at least one second speaker jack comprise water-tight connections.

4. The solar powered digital music player for a grave system of claim 1 wherein said plurality of first conductive wires and said plurality of second conductive wires comprise water tight terminal endings.

5. The solar powered digital music player for a grave system of claim 1 wherein said at least one rechargeable battery comprises a Lithium Ion battery.

6. The solar powered digital music player for a grave system of claim 5 wherein said rechargeable battery comprises a long-life battery.

7. The solar powered digital music player for a grave system of claim 1 wherein said grave digital music player assembly further comprises a removable data storage device for high volume data storage.

8. The solar powered digital music player for a grave system of claim 7 wherein said grave digital music player assembly is able to output a plurality of stored digitally recorded songs to said at least one first speaker jack and said at least one second speaker jack.

9. The solar powered digital music player for a grave system of claim 8 wherein said grave marker further comprises a digital output jack such that said user-listener is able to listen to a pre-recorded song at a later date.

10. The solar powered digital music player for a grave system of claim 7 wherein said grave digital music player assembly further comprises a casket speaker jack on said exterior of said casket for conductively coupling said casket speaker to said electronic digital player.

11. The solar powered digital music player for a grave system of claim 1 wherein said removable data storage device further comprises a data partition, said data partition forming a plurality of channels.

12. The solar powered digital music player for a grave system of claim 11 wherein said grave digital music player assembly is able to play an mp3 data compressed sound.

13. The solar powered digital music player for a grave system of claim 1 wherein said conductive coupling means for coupling said casket speaker jack to said electronic digital music player further comprises water tight connections.

14. The solar powered digital music player for a grave system of claim 1 wherein said plurality of first conductive wires comprises a power conductor wire from said at least one solar panel to said rechargeable battery and at least one conductor from said at least one first speaker jack to said electronic digital music player.

15. The solar powered digital music player for a grave system of claim 14 wherein said plurality of first conductive wires further comprise insulated conductors.

16. The solar powered digital music player for a grave system of claim 1 wherein said at least one speaker is removably attached within said inner volume of said casket for playing a recorded sound continuously when a battery voltage charge meets at least a minimum required charge level of said grave digital music player assembly.

17. A solar powered digital music player for a grave system comprising:

a grave digital music player assembly comprising:

a grave marker having:

a top;

at least one vertical side;

an interior portion;

at least one solar panel;

at least one first speaker jack;

a plurality of first conductive wires;

an electronic digital music player;

at least one speaker;

at least one second speaker jack;

a plurality of second conductive wires; and at least one rechargeable battery;

wherein said grave digital music player assembly is able to play at least one musical sound for a user-listener visiting a grave site;

wherein said grave digital music player assembly is able to output a plurality of stored digitally recorded songs to said at least one first speaker jack and said at least one second speaker jack;

wherein said at least one solar panel is arranged along said top side of said grave marker such that said at least one solar panel is able to collect available sunlight and convert said available sunlight into a stored electrical power within said at least one rechargeable battery;

wherein said rechargeable battery comprises a long-life battery;

wherein said at least one rechargeable battery comprises a Lithium Ion battery;

wherein said at least one first speaker jack is located on said at least one vertical side of said grave marker;

wherein said at least one first speaker jack and said plurality of first conductive wires are cast within said grave marker during a manufacturing process such that a coupling end of said at least one first speaker jack is exposed to an exterior of said grave marker;

wherein said at least one first speaker jack and said at least one second speaker jack comprise water-tight connections;

wherein said plurality of first conductive wires and said plurality of second conductive wires comprise water tight terminal endings;

wherein said plurality of first conductive wires are located within said interior portion of said grave marker and are in conductive communication with said at least one solar panel, said at least one first speaker jack, said electronic digital music player, and said at least one rechargeable battery;

wherein said plurality of first conductive wires comprises a power conductor wire from said at least one solar panel to said rechargeable battery and at least one conductor from said at least one first speaker jack to said electronic digital music player;

wherein said grave digital music player assembly further comprises a removable data storage device for high volume data storage;

wherein said removable data storage device further comprises a data partition, said data partition forming a plurality of channels;

wherein said electronic digital music player is located within a sealed box near a bottom end of said grave marker;

wherein said at least one speaker is located within an inner volume of a casket;

wherein said at least one speaker is removably attached within said inner volume of said casket for playing a recorded sound continuously when a battery voltage charge meets at least a minimum required charge level of said grave digital music player assembly;

wherein said at least one second speaker jack is located within a sidewall of said casket and on an exterior of said casket such that a male speaker jack is able to couple thereto from an exterior of said casket;

wherein said plurality of second conductive wires are in communication with said electronic digital music player via a recorder-player jack, said at least one second speaker jack, said at least one speaker, at least one casket speaker jack and said at least one rechargeable battery;

wherein said grave digital music player assembly further comprises said casket speaker jack on said exterior of said casket for conductively coupling said casket speaker to said electronic digital music player;

wherein said conductive coupling means for coupling said casket speaker jack to said electronic digital music player further comprises water tight connections;

wherein said at least one rechargeable battery is in communication with said plurality of first conductive wires, said at least one solar panel, said at least one first speaker jack, said electronic digital music player, said at least one second speaker jack, and said at least one speaker; and wherein said grave digital music player assembly is useful for recording said at least one musical sound via a user-recorder for playback at a later time to said user-listener via said at least one speaker and said at least one first speaker jack to provide at least one memory and a comfort to said user-listener.

18. The solar powered digital music player for a grave system of claim 17 further comprising a kit including:

said grave marker having said at least one solar panel and said at least one first speaker jack in communication with said plurality of first conductive wires;

one said electronic digital music player;

said at least one speaker;

said at least one second speaker jack, said at least one rechargeable battery;

said plurality of second conductive wires able to be in communication with said grave marker, said electronic digital music player, said at least one speaker; said at least one second speaker jack, and said at least one rechargeable battery; and at least one set of user installation instructions.

* * * * *